United States Patent [19]

Oquita

[11] 4,186,514

[45] Feb. 5, 1980

[54] SLIP-KNOT PINATA

[76] Inventor: Ramiro Oquita, 6014 Chandler Dr., San Diego, Calif. 92117

[21] Appl. No.: 925,006

[22] Filed: Jul. 14, 1978

Related U.S. Application Data

[63] Continuation-in-part of Ser. No. 873,804, Jan. 31, 1978, which is a continuation-in-part of Ser. No. 758,215, Jan. 10, 1977, Pat. No. 4,092,718, which is a continuation-in-part of Ser. No. 617,602, Sep. 29, 1975, Pat. No. 4,015,364.

[51] Int. Cl.[2] ..... B65D 5/36; A63H 33/00

[52] U.S. Cl. ..... 46/11

[58] Field of Search ..... 46/11, 38; 229/8, 7 R; 220/260

[56] References Cited

U.S. PATENT DOCUMENTS

| | | | |
|---|---|---|---|
| 1,732,282 | 10/1929 | Sage | 229/7 R X |
| 3,702,675 | 11/1972 | Bajo | 46/11 |

FOREIGN PATENT DOCUMENTS

| | | | |
|---|---|---|---|
| 490867 | 2/1953 | Canada | 46/38 |
| 6682 | of 1915 | United Kingdom | 220/260 |

*Primary Examiner*—F. Barry Shay

*Attorney, Agent, or Firm*—Nilsson, Robbins, Dalgarn, Berliner, Carson & Wurst

[57] ABSTRACT

A pinata adapted to contain and release a plurality of small items includes two cooperating walls which are releasably held in assembled relation to define a substantially enclosed chamber for the items. One or more lines are employed to suspend the pinata, as well as to so hold the walls through, for example, the formation of a slip-knot or the releasable holding of a release pin by one of the lines against a washer, button or other similar element. Release of the walls from the assembled relation is accomplished by pulling one of a plurality of lines or ribbons connected to a line employed in the formation of the slip-knot, or connected to the release pin. Each of the plurality of lines or ribbons extends externally of the chamber, and the line or ribbon which is pulled to accomplish the release is indistinguishable from other lines or ribbons.

9 Claims, 10 Drawing Figures

SLIP-KNOT PINATA

Cross-Reference to Related Applications

This application is a continuation-in-part of application Ser. No. 873,804, filed Jan. 31, 1978 and entitled "PULL-PIN PINATA", which is a continuation-in-part of application Ser. No. 758,215, filed Jan. 10, 1977 and entitled "BALLOON PINATA", now U.S. Pat. No. 4,092,718, which in turn is a continuation-in-part of application Ser. No. 617,602, filed Sept. 29, 1975, entitled "BREAK-AWAY PINATA" and now U.S. Pat. No. 4,015,364.

FIELD OF THE INVENTION

The field of art to which the invention pertains includes the field of containers, specifically pinatas.

BACKGROUND AND SUMMARY OF THE INVENTION

Pinata breaking celebrations are quite popular in Mexico and in the Mexican communities of the Southwestern United States. Pinatas are traditionally a pot or container ornamented with colorful paper and filled with candy, nuts, confetti and/or token gifts such as small toys and the like. The pinata is suspended above a party area and at the appropriate time, and with celebration, it is broken so that the treats are scattered among the guests who in turn can keep whatever they collect. The usual method of breaking the pinata is by beating it with a club or cane; and this is done by either a blindfolded child who is the subject of the celebration or by several children in succession, each given a certain number of turns in which to break the pinata. Unfortunately, as a result of the enthusiasm of the guests gathering close to the pinata so as to obtain a large number of candies or gifts, it occasionally happens that a child is hit by a club or cane. Additionally, the traditional pinata is made of clay pottery, and large falling fragments can cause injury to a young child. Modern pinatas are often made of paper-mache, avoiding the dangers of cracked clay fragments; but such pinatas are generally more difficult to break, requiring greater swings with the resultant danger from that aspect to the children. My prior application Ser. No. 617,602, now U.S. Pat. No. 4,015,364, is directed to a pinata having a bottom wall formed with at least one line of weakness so that it will break-away upon successive pulls or jerks on a suspension line. My prior application Ser. No. 758,215 is directed to a pinata having a bottom wall which breaks-away upon the puncturing of a balloon. Such pinatas require the replacement of at least one component for each use. The present invention, as with my prior application Ser. No. 873,804, is directed to a pinata which is completely reusable.

In accordance with the invention, a pinata includes first and second mutually cooperating walls; means for suspending the pinata and for releasably holding the walls in assembled relation to define a substantially enclosed chamber, the suspending and holding means including a first elongated flexible member, disposed in a releasable locking arrangement for holding the walls in the assembled relation and for releasing the walls from the assembled relation; and means, including a plurality of elongated flexible members, having a like appearance externally of the chamber, for releasing the first flexible member from the locking arrangement in response to the application of a force to a part of the means. A plurality of small items may then be carried on bottom portions of the walls, within the enclosed chamber, and may be released from the chamber upon release of the walls from the assembled relation. In accordance with other more detailed aspects, the first elongated flexible member may also be employed in the suspension of the pinata.

In accordance with other features, a pinata includes the mutually cooperating walls and means for suspending the pinata and for releasably holding the walls, as stated above, along with a plurality of elongated flexible members extending externally of the chamber when the walls are in their assembled relation, having a like appearance externally of the chamber, at least one of these members for releasing the first flexible member from the locking arrangement through the application of a force to the releasing flexible member sufficient to accomplish the release.

In accordance with more detailed aspects of these features, the first flexible member is disposed in a self-locking arrangement comprising the formation of a slip-knot by this member. The suspending and holding means may further alternatively include, for example, a holding flexible member for forming a slip-knot with the first flexible member, or, on the other hand, a support element defining at least one hole for passing the first member through the support element and a release pin which cooperates with the releasing flexible member and with the first flexible member and support element. In the latter case, the release pin is connected to the releasing flexible member and releasably held to the support element by the first flexible member.

DETAILED DESCRIPTION

As required, detailed illustrative embodiments of the invention are disclosed herein. However, it is to be understood that these embodiments merely exemplify the invention which may take forms that are different from the specific illustrative embodiments disclosed. Therefore, specific structural and functional details are not to be interpreted as necessarily limiting, but as a basis for the claims which define the scope of the invention.

Figure 1:
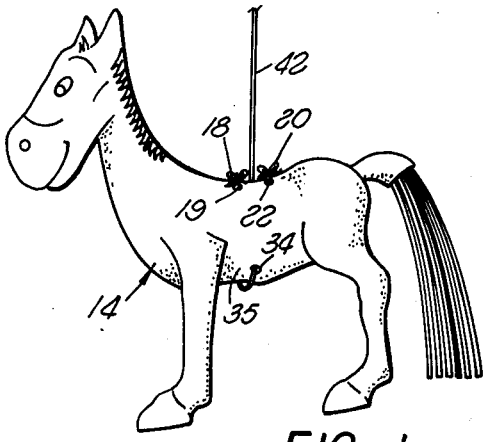
FIG. 1 is an elevational view showing an assembled pinata in accordance with the invention.
Figure 2:
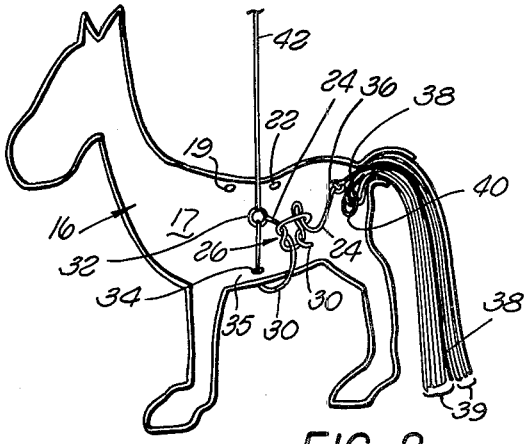
FIG. 2 is the elevational view of FIG. 1, partially broken away.
Figure 3:
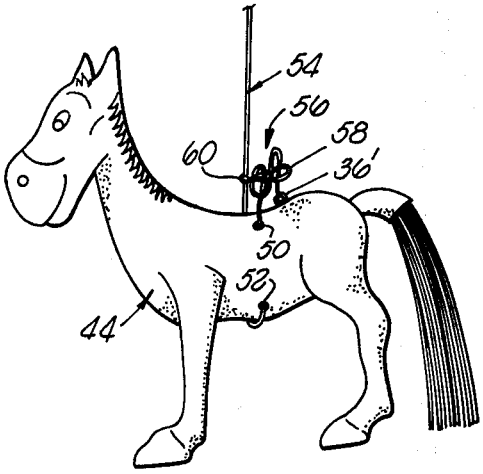
FIG. 3 is an elevational view showing an alternative embodiment of a pinata in accordance with the invention.
Figure 4:
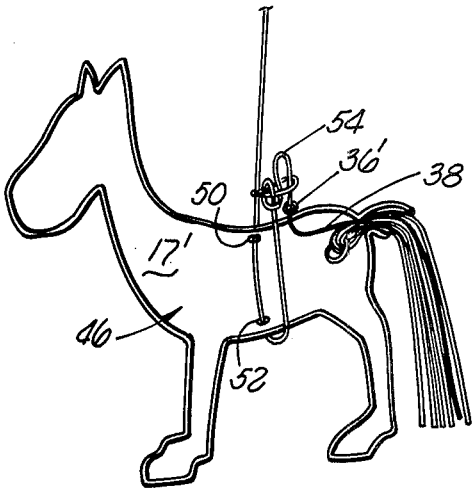
FIG. 4 is the elevational view of FIG. 3, partially broken away.
Figure 6:
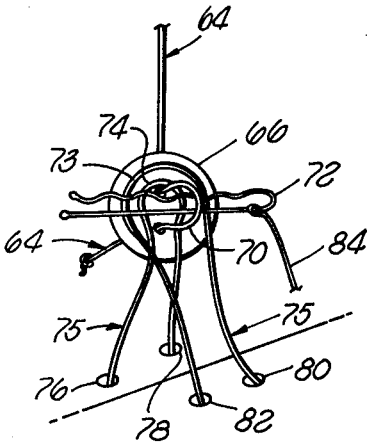
FIGS. 6 and 7 show alternative ways of accomplishing the operational effect of the pinatas of FIGS. 1 and 3.
Figure 7:
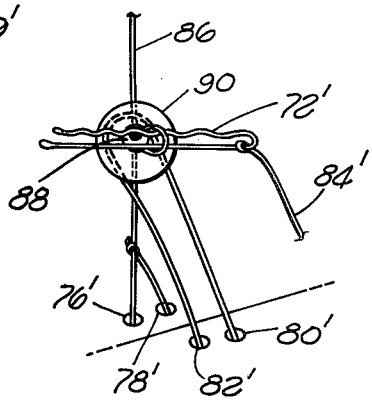

Referring to FIGS. 1 through 4, 8 and 10, in each of three embodiments, a substantially enclosed chamber, which may contain small items such as candy, nuts, small toys and the like, is formed when two symmetrical walls are held together. In the embodiments, flexible lines are used for suspension purposes, and to hold the walls together. In FIGS. 3 and 4, and in FIGS. 8 and 10, a single line is employed to suspend the pinata and to form a slip-knot which can be released by a pulling on the line. The release of the slip-knot permits the walls to separate and spread open from the top down. This results in the spilling out or release of the treats and the like which normally would be contained in the chamber. In FIGS. 1 and 2, two lines are employed in the formation of a slip-knot, and a third line is employed in the suspension system. Further, in these figures, a hinge-like connection is employed to somewhat permanently hold the top of the walls together at this connection, and upon release of the slip-knot, the walls spread open at the bottom. In all of the above cases, a releasing line or ribbon is connected to accomplish the release of the slip-knot and of the walls from one another upon the application of a force to the releasing line or ribbon of sufficient magnitude. Alternatives to the slip-knot arrangement, incorporating a button or washer and a release pin connected to a release line, are shown in FIGS. 6 and 7.

Referring to FIGS. 1 and 2, a horse-shaped pinata includes two (foreground and background) cooperating walls 14 and 16 which are held together to define a substantially enclosed chamber 17. A hinge-like connection is formed along top portions of the walls by passing a front hinge line 18 through a pair of front hinge holes 19, one defined by each wall, and forming a knot to hold the ends of the line together; and by doing essentially the same, for a rear hinge line 20 and a pair or rear hinge holes 22. By reference to these figures, it will, of course, be evident that FIG. 2 shows the interior of the background wall 16. In the chamber 17, defined by the walls, a locking line 24 forms a slip-knot 26 with a holding line 30. The holding line extends from a suspension ring 32, inside the pinata, through a pair of lower holes 34, each defined by a bottom portion of a respective wall, together generally designated at 35. As shown, the locking line 24 is connected to extend between the suspension ring 32 and small connector ring 36; and through the formation of the slip-knot 26, the walls 14 and 16 are tightly held together to form the substantially enclosed chamber 17 to contain the candy, toys and the like.

Figure 5:
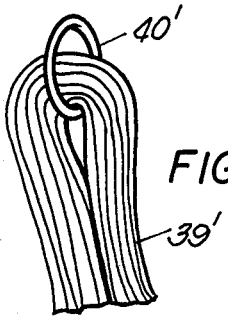
FIG. 5 is a perspective view showing how decoy lines for the pinatas of FIGS. 1–4 are mounted.

Through the connector ring 36, the locking line 24 is connected to a releasing line 38 which extends from inside the chamber outside of the chamber to form, with a plurality of additional lines 39 having a like appearance to the release line externally of the chamber, a tail for the horse-shaped pinata. The additional, decoy lines 39 are mounted on a tail ring 40 in looped fashion (see FIG. 5 showing an essentially identical tail ring 40' and decoy lines 39'), and are held in position by tightly fitting wall structure at the tail end of the pinata. Thus, when, for example, participants in a celebration pull one of the decoy lines, essentially nothing of significance will happen other than a pulling of the line through the ring. However, when a participant pulls the releasing line 38, the slip-knot 26 (which, of course, will be tightly knotted) will become unknotted, permitting the pinata to open at the bottom and fall until the suspension ring 32 engages upper wall structure near a suspension hole (between the two walls) through which a suspension line 42 passes, and permitting the walls to come apart at the lower connection and the pinata to spill out its favors. The suspension line 42 extends from the supension ring 32 through the suspension hole, having a diameter which is less than the diameter of the suspension ring, to the exterior of the chamber 17 to be secured to structure (not shown) exterior to the chamber. The pinata walls will of course still be joined at the hinge-like connection after the slip-knot is released.

Although rather similar to the pinata of FIGS. 1 and 2, the pinata of FIGS. 3 and 4 does incorporate some noteworthy differences. In the pinata of FIGS. 3 and 4, two (foreground and background) walls 44 and 46 define symmetrical pairs of upper and lower holes 50 and 52 through which a single suspending and locking line 54 is threaded before being self-locked in a single line slip-knot 56 to hold the walls together. In forming the slip-knot, this line 54 is formed into an initial loop 58 that is secured with a tight knot 60. After being formed into the initial loop 58 and knotted to hold the loop, the line, is extended into a pinata chamber 17' which is essentially identical to the pinata chamber of FIGS. 1 and 2. As shown, the slip-knot 56 is completed with a portion of the line which again extends out of the chamber. Also, in this case a connector ring 36', essentially identical to the connector ring of FIG. 2, is employed to connect the line to a releasing line 38', essentially identical to the releasing line of FIGS. 1 and 2, which however passes from outside the chamber into the chamber (through a hole in the wall structure) before again extending out of the chamber with the decoy lines. Also, in this case, the falling of the pinata and a separation at both the upper and lower pairs of holes 50 and 52 will be terminated by the engaging by wall structure near one (foreground) of the pairs of upper holes, of the connector ring 36'. Thus, the connector ring of FIGS. 3 and 4 has a diameter greater than the diameter of that hole.

It is of course evident that in either of the horse-shaped embodiments, a direct knot formed by the releasing line 38 or 38' and locking 24 or suspending and locking line 54 could be used to replace the connector ring 36 or 36'. In the second embodiment, however, the knot must be large enough to terminate the falling and separation by engagement with the wall structure about the just-mentioned upper hole. It is further noted that in the pinata of FIGS. 3 and 4, a single integral line 54, is employed to accomplish the suspension of the pinata and the holding of the walls in assembled relation. The same line, is of course, also disposed in the slip-knot arrangement to hold the walls together in releasable fashion.

FIGS. 6 and 7 show mechanisms, particularly adapted to use with the hinge-like connection of FIGS. 1 and 2, but also readily employed with variations, such as in FIGS. 3 and 4. In FIG. 6, a button-mechanism suspension line 64, similar to the suspension line 42 of FIGS. 1 and 2 is threaded through a button 66 to form a loop 70 which holds a release pin 72 to the button under the force of the weight of a pinata. The release pin 72 will in turn tightly hold looped portions 73 and 74 of a connecting line 75 to the button 66. The connecting line 75 runs from outside (below) the pinata up through a front, background wall hole 76, out again through a back, background wall hole 78, in again through a back, foreground wall hole 80, and back out again through a front, foreground wall hole 82. The initial and end portions of the line may then be knotted together along the underside of the pinata. As is evident, a pull (of sufficient magnitude) along a release line 84 will disengage the release pin, permitting the loops to fall away from the button 66 and to terminate a separation of the walls by engaging wall structure in the vicinity of the front and back wall holes. The button 66 may be employed to terminate the falling of the pinata in the fashion of the suspension ring 32 of FIG. 2.

The mechanism of FIG. 7 operates in a somewhat different fashion while incorporating a release pin 72' and release line 84', essentially identical to those of FIG. 6. In this case, a single suspension and connecting line 86 is looped through a hole 88 defined by a washer 90 to hold the pin against the washer, and then passes out from and into the chamber a number of times, respectively, before being knotted to itself. Front and back wall holes 76', 78', 80' and 82', essentially respectively identical to the comparable aforementioned front and back wall holes, are provided for this purpose. Here, the suspension and connecting line 86 initially passes out of the chamber through the front, background wall hole 76', returns to the chamber through the front, foreground wall hole 82', loops behind the washer, passes out of the chamber through the back, foreground wall hole 80', and again passes into the chamber through the back, background wall hole 78'. The loop along the line might conveniently be held to the back of the washer by the line itself (as shown); however, the interaction of the release pin 72', washer 90 and the portion of the line along the loop extending through the hole 88 in the washer, will maintain the held-together configuration of FIG. 7 until the release pin is disengaged. Upon the disengagement of the release pin, the walls will separate near the holes and the pinata will fall until the loop shown along the back side of the washer and the loop formed by the knot in the suspending and connecting line engage foreground wall structure and background wall structure, respectively, in the vicinity of the wall holes.

Figure 8:
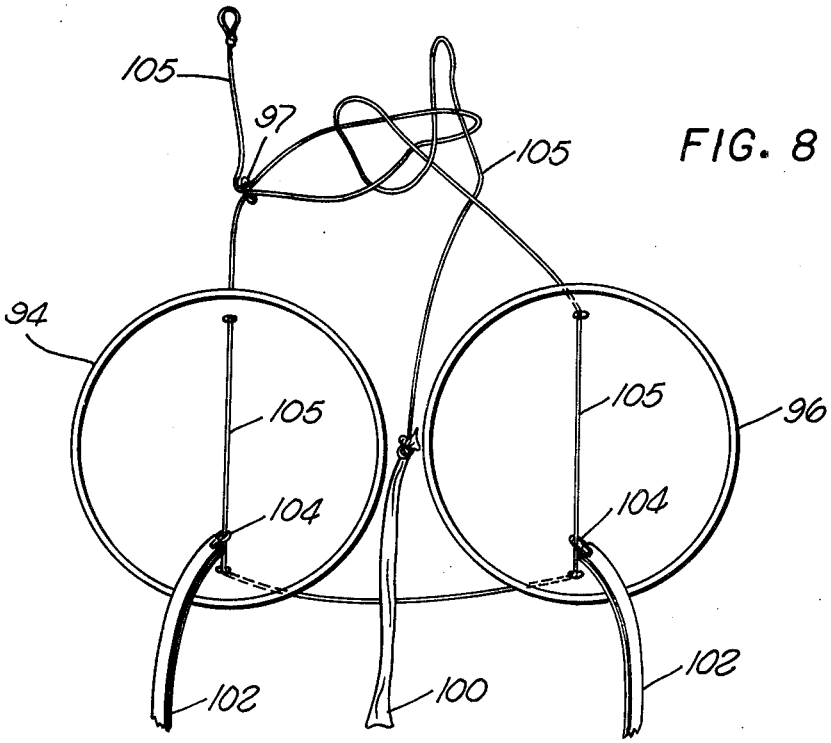
FIG. 8 is an elevational view showing another alternative embodiment of a pinata in accordance with the invention, which is not in assembled relation.
Figure 9:
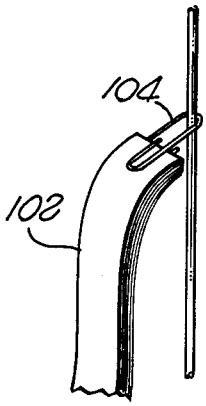
FIG. 9 is a persective view showing decoy ribbons of FIG. 8 and how the ribbons are mounted.
Figure 10:
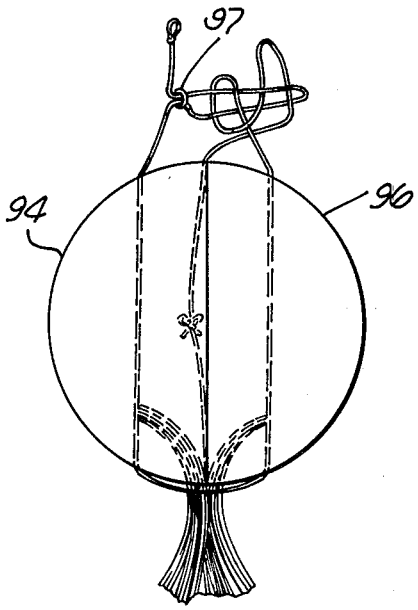
FIG. 10 is an elevational view showing the pinata of FIG. 8 in assembled form with an exaggerated slip-knot to highlight the threading of the knot.

The embodiment of FIGS. 8 through 10, illustrate variations easily understood by reference to the previously-described embodiments. In this regard, and in this case, the two (left and right) walls 94 and 96 are hemispherical. In addition, an initial loop is formed by being slidably inserted through a slip ring 97. Thus, in this case, the initial loop is pulled tight to tighten the slip knot. Further, a release ribbon 100 and decoy ribbons 102 are employed; and the decoy ribbons are removably mounted inside the chamber with paper clips 104, e.g. adhesively held to a single self-locking line 105 which is employed. Thus, the ribbons, except for the release ribbon, may be pulled one at a time from between the paper clips 104. In the pinata of FIGS. 8 through 10, the single, self-locking line is employed in the suspension and holding together of the pinata (as in FIGS. 3 and 4), and a knot formed by the release ribbon and line is employed to terminate the falling of the pinata and the separation of the walls. Although convenient, the slip ring 97 is of course unnecessary.

The pinata walls in each of the foregoing embodiments may be conveniently constructed of rigid, foamed polystyrene, but a variety of alternative materials may, of course, readily be employed. Further, it will be evident that in a number of instances, several lines could readily be connected to essentially replace and act as a single line, or a single line could readily be used to essentially replace and act as several lines.

In view of the above description, and as initially indicated, it will be appreciated that the foregoing embodiments are presented by way of illustration, and various changes can be made without departing from the spirit of the invention as defined by the appended claims.

What is claimed is:

1. A pinata, comprising:

first and second mutually cooperating walls;

means for suspending said pinata and for releasably holding said walls in assembled relation to define a substantially enclosed chamber, whereby a plurality of small items may be carried in said chamber, said suspending and holding means including a first elongated flexible member, said member being disposed in a releasable locking arrangement for holding said walls in said assembled relation and for releasing said walls from said assembled relation whereby a plurality of said items may be released from said chamber; and a plurality of elongated flexible members associated with said pinata externally of said chamber, means, including one of said plurality of elongated flexible members, for releasing said first flexible member from said locking arrangement in response to the application of a force to a part of said latter means.

2. The pinata of claim 1 wherein said walls are hingedly connected.

3. A pinata, comprising:

first and second mutually cooperating walls;

means for suspending said pinata and for releasably holding said walls in assembled relation to define a substantially enclosed chamber, whereby a pluraliy of small items may be carried in said chamber, said suspending and holding means including a first elongated flexible member, said member being disposed in a releasable locking arrangement for holding said walls in said assembled relation and for releasing said walls from said assembled relation whereby a plurality of said items may be released from said chamber; and a plurality of elongated flexible members extending externally of said chamber when said walls are in said assembled relation, at least one of said plurality of members being connected with said first elongated member for releasing said first flexible member from said locking arrangement through the application of a force to said releasing flexible member sufficient to accomplish said release.

4. The pinata of claim 3 wherein said locking arrangement in which said first flexible member is disposed is a self-locking arrangement.

5. The pinata of claim 4 wherein said self-locking arrangement comprises the formation of a slip-knot by said first flexible member.

6. The pinata of claim 3 wherein said suspending and holding means further comprises a holding flexible member for forming a slip-knot with said first flexible member for releasably holding said first flexible member in said locking arrangement.

7. The pinata of claim 3 wherein said suspending and holding means further comprises:

a support element defining at least one hole for passing said first flexible member through said support element; and a release pin, connected to said releasing flexible member, said release pin being releasably held to said support element by said first flexible member.

8. A pinata, comprising:

first and second mutually cooperating walls;

means for suspending said pinata and for releasably holding said walls in assembled relation to define a substantially enclosed chamber, whereby a plurality of small items may be carried in said chamber, said suspending and holding means including a first elongated flexible member for suspending said pinata, said member being disposed in a releasable locking arrangement for holding said walls in said assembled relation and for releasing said walls from said assembled relation whereby a plurality of said items may be released from said chamber; and a plurality of elongated flexible members associated with said pinata externally of said chamber, means, including one of said plurality of elongated flexible members, for releasing said first flexible member from said locking arrangement in response to the application of a force to a part of said latter means.

9. A pinata, comprising:

first and second mutually cooperating walls;

means for suspending said pinata and for releasably holding said walls in assembled relation to define a substantially enclosed chamber, whereby a plurality of small items may be carried in said chamber, said suspending and holding means including a first line, said line being disposed in a releasable locking arrangement, including the formation of a slip-knot, for holding said walls in said assembled relation and for releasing said walls from said assembled relation whereby a plurality of said items may be released from said chamber; and a plurality of strings or ribbons associated with said pinata externally of said chamber, said plurality of strings or ribbons including means for releasing said first line from said locking arrangement in response to the application of a force to a part of said latter means.

* * * * *